US010677120B2

(12) United States Patent
He et al.

(10) Patent No.: US 10,677,120 B2
(45) Date of Patent: Jun. 9, 2020

(54) BUILT-IN OIL-GAS SEPARATING DEVICE

(71) Applicant: FUSHENG INDUSTRIAL (SHANGHAI) CO., LTD, Shanghai (CN)

(72) Inventors: Dong-Ping He, Shanghai (CN); Yue Yu, Shanghai (CN); Quan Meng, Shanghai (CN)

(73) Assignee: FUSHENG INDUSTRIAL (SHANGHAI) CO., LTD, Shanghai (CN)

( * ) Notice: Subject to any disclaimer, the term of this patent is extended or adjusted under 35 U.S.C. 154(b) by 282 days.

(21) Appl. No.: 15/922,122

(22) Filed: Mar. 15, 2018

(65) Prior Publication Data

US 2018/0334937 A1 Nov. 22, 2018

(30) Foreign Application Priority Data

May 16, 2017 (CN) ..... 2017 2 0559670 U

(51) Int. Cl.
*F01M 11/08* (2006.01)

(52) U.S. Cl.
CPC ..... *F01M 11/08* (2013.01)

(58) Field of Classification Search
None
See application file for complete search history.

(56) References Cited

U.S. PATENT DOCUMENTS 3,785,755 A * 1/1974 Novak ..... F04C 29/0007 418/85
4,563,138 A * 1/1986 Hofmann ..... F04C 23/00 418/97
5,037,278 A * 8/1991 Fujio ..... F04C 18/0215 418/181
5,899,667 A * 5/1999 Greer ..... F04B 39/16 417/313
6,409,804 B1 * 6/2002 Cook ..... B01D 46/0031 55/423
6,499,965 B2 * 12/2002 Cook ..... F01C 21/007 210/512.1
7,578,863 B2 * 8/2009 Becker ..... B01D 46/0031 55/319

* cited by examiner

*Primary Examiner* — Christopher P Jones
*Assistant Examiner* — Phillip Y Shao
(74) *Attorney, Agent, or Firm* — Li & Cai Intellectual Property (USA) Office

(57) ABSTRACT

A built-in oil-gas separating device includes a secondary oil-gas separator, a main oil-gas separator, an oil-gas barrel, an oil-gas barrel liner, and an oil-gas barrel lid. The secondary oil-gas separator is disposed inside the main oil-gas separator. The oil-gas barrel liner is disposed around the main oil-gas separator. The oil-gas barrel liner is disposed inside the oil-gas barrel. Upper end faces of the secondary oil-gas separator and the main oil-gas separator are sealingly connected to a lower end face of the oil-gas barrel lid. The oil-gas barrel lid has a gas discharging hole located above the secondary oil-gas separator. The gas discharging hole is sealingly connected to a pressure maintenance valve. The compressed air obtained by the double layer filtration structure of the present disclosure can achieve a 40% reduction in oil content as compared with the compressed air obtained by the ordinary single layer filtration structure.

2 Claims, 3 Drawing Sheets

BUILT-IN OIL-GAS SEPARATING DEVICE

BACKGROUND OF THE INVENTION

1. Field of the Invention

The present disclosure relates to an oil-gas separator, and in particular, to a built-in oil-gas separating device.

2. Description of Related Art

Built-in oil-gas separating devices are widely used in various oil-injected compressor systems to separate lubricating oil from compressed air so that pure compressed air can be provided to users. Most of the built-in oil-gas separating devices include a single-layer filtration structure, and do not include any oil return device. As the usage time increases, the lubricating oil will be gradually accumulated on the bottom portion of the oil-gas separator after oil-gas mixture is filled in the oil-gas separator. If the lubricating oil is not recycled, it will be discharged with the compressed air, thus reducing the treatment effect of the oil-gas separator and increasing the oil consumption of the compressor system.

In this regard, the present disclosure provides a built-in oil-gas separating device to overcome the aforementioned drawbacks.

SUMMARY OF THE INVENTION

The main object of the present disclosure is to solve the drawbacks associated with the prior art.

The present disclosure provides a built-in oil-gas separating device which includes a secondary oil-gas separator, a main oil-gas separator, an oil-gas barrel, an oil-gas barrel liner, and an oil-gas barrel lid. The secondary oil-gas separator is disposed inside the main oil-gas separator. The oil-gas barrel liner is disposed around the main oil-gas separator. The oil-gas barrel liner is disposed inside the oil-gas barrel. An upper end face of the secondary oil-gas separator and an upper end face of the main oil-gas separator are sealingly connected to a lower end face of the oil-gas barrel lid. The oil-gas barrel lid has a gas discharging hole located above and in air-communication with a space surroundingly defined by the secondary oil-gas separator, and the gas discharging hole is sealingly connected to a pressure maintenance valve.

In one preferred embodiment of the present disclosure, the oil-gas barrel lid has two oil discharging holes respectively communicated with the space surroundingly defined by the secondary oil-gas separator and a space surroundingly defined by the main oil-gas separator. A secondary oil return steel pipe is inserted into the oil discharging hole communicated with the space surroundingly defined by the secondary oil-gas separator. A lower end of the secondary oil return steel pipe is arranged adjacent to a bottom portion of the secondary oil-gas separator. An upper end of the secondary oil return steel pipe is sealingly connected to an end of a secondary high pressure oil pipe via a check valve. A main oil return steel pipe is inserted into the oil discharging hole communicated with the space surroundingly defined by the main oil-gas separator. A lower end of the main oil return steel pipe is arranged adjacent to a bottom portion of the main oil-gas separator. An upper end of the main oil return steel pipe is sealingly connected to an end of a main high pressure oil pipe via another check valve. The other end of the main high pressure oil pipe and the other end of the secondary high pressure oil pipe are respectively and sealingly connected to two oil return holes located at a side of a machine body, and the two oil return holes are communicated with a compressing chamber of the machine body.

The advantage of the present disclosure is that the compressed air obtained by the double layer filtration structure of the present disclosure can achieve a 40% reduction in oil content compared with the compressed air obtained by the ordinary single layer filtration structure. In addition, since the built-in oil-gas separating device of the present disclosure includes a well design oil return device, the built-in oil-gas separating device is capable of consistently providing the compressed air with low oil content over its service life, thus greatly reducing the loss of the lubricating oil and reducing the environmental pollution.

For further understanding of the present disclosure, the following embodiments are provided to facilitate the disclosure of the present disclosure.

DETAILED DESCRIPTION OF PREFERRED EMBODIMENTS

The aforementioned illustrations and following detailed descriptions are exemplary for the purpose of further explaining the scope of the instant disclosure. Other objectives and advantages related to the instant disclosure will be illustrated in the subsequent descriptions and appended drawings. In addition, for an easy instruction, similar reference numbers or symbols refer to elements alike.

Figure 1:
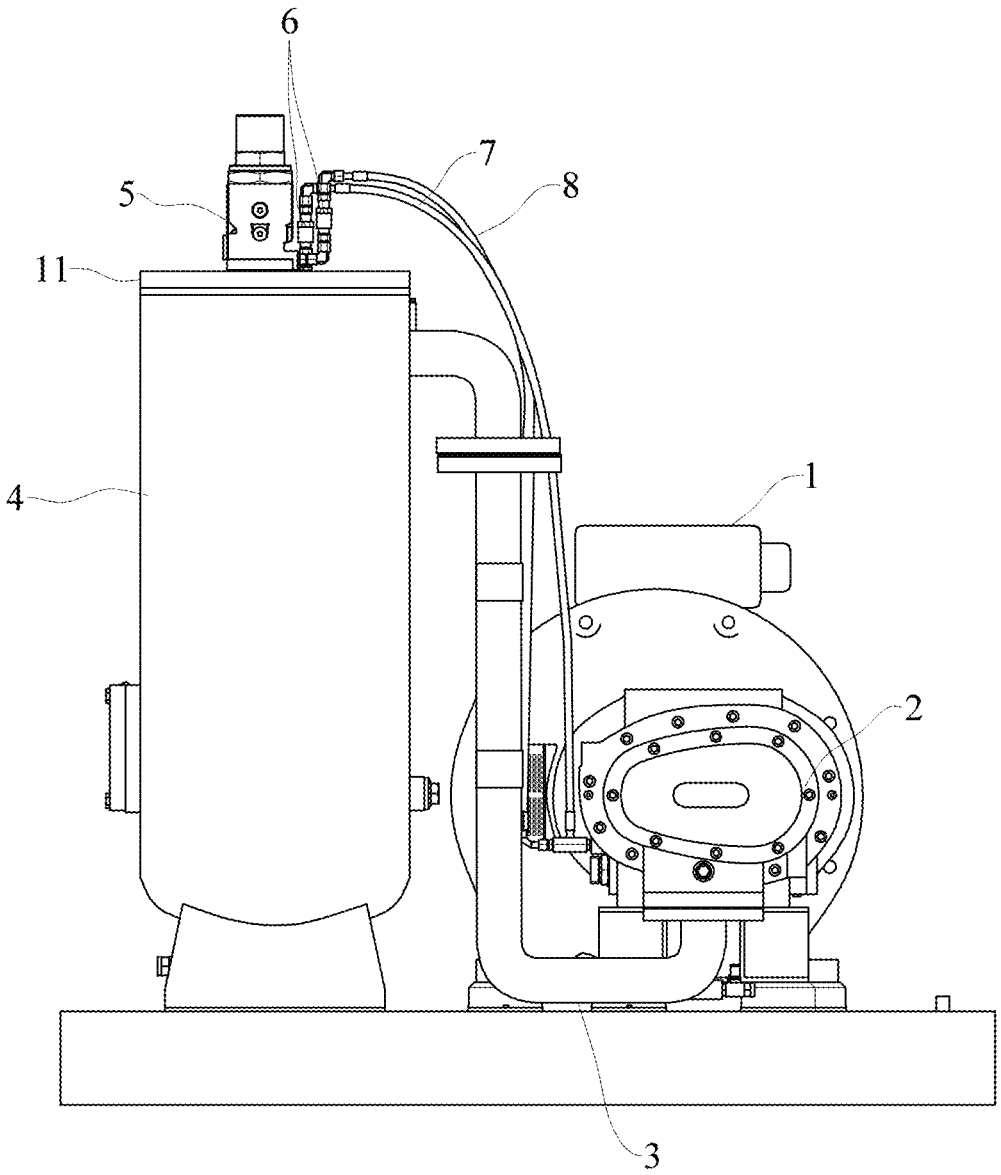
FIG. 1 is a front side view showing a built-in oil-gas separating device according to an embodiment of the present disclosure.
Figure 2:
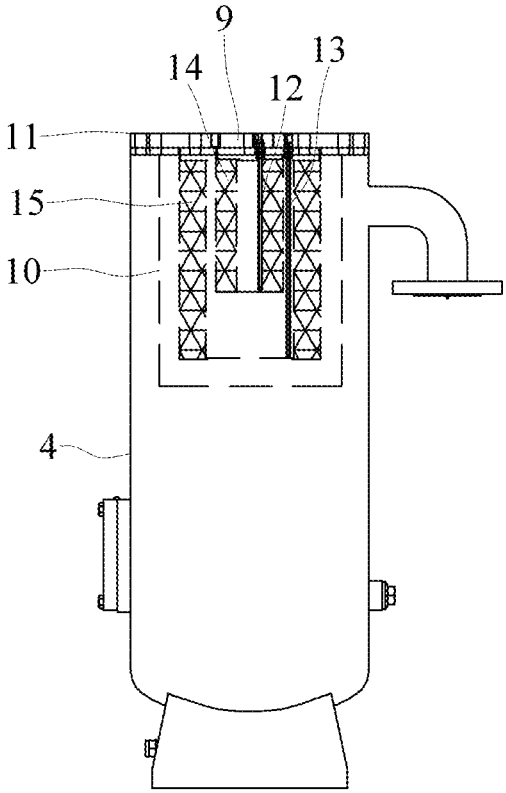
FIG. 2 is a cross-sectional view of the oil-gas barrel of FIG. 1.
Figure 3:
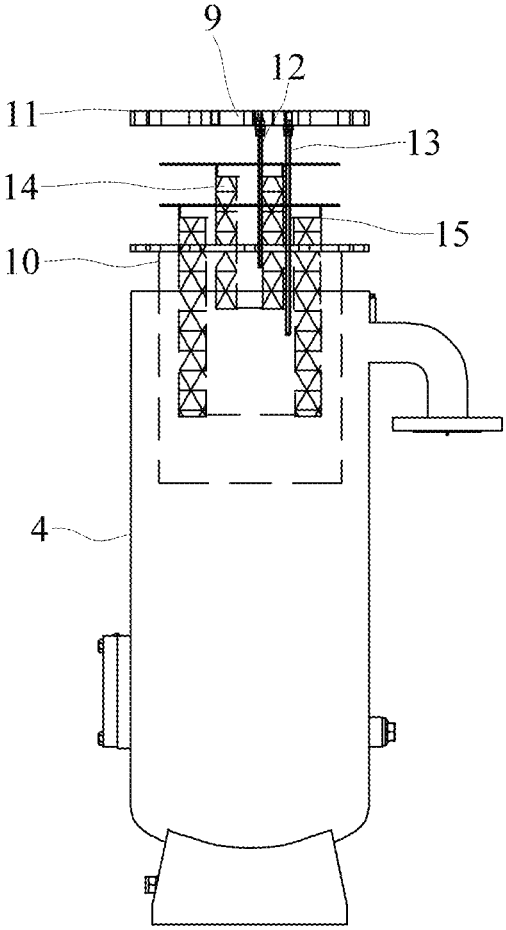
FIG. 3 is an exploded view of FIG. 2.

Referring to FIGS. 1 to 3, an embodiment of the present disclosure disclosures a built-in oil-gas separating device which includes a secondary oil-gas separator 14, a main oil-gas separator 15, an oil-gas barrel 4, an oil-gas barrel liner 10, and an oil-gas barrel lid 11. The secondary oil-gas separator 14 is disposed inside the main oil-gas separator 15. The oil-gas barrel liner 10 is disposed around the main oil-gas separator 15. That is, the main oil-gas separator 15 is disposed inside the oil-gas barrel liner 10. The oil-gas barrel liner 10 is disposed inside the oil-gas barrel 4. The oil-gas barrel liner 10 has a protection function which can prevent the main oil-gas separator 15 from being directly impacted by the high-pressure oil-gas mixture. The secondary oil-gas separator 14, the main oil-gas separator 15, and the oil-gas barrel liner 10 are commonly disposed inside a barrel shell of the oil-gas barrel 4. The oil-gas barrel lid 11 is covered on the barrel shell of the oil-gas barrel 4. It should be noted that the portions where the above components in contact with each other are preferably sealed via flat gaskets. For example, an upper end face of the secondary oil-gas separator 14 and an upper end face of the main oil-gas separator 15 are sealingly connected to a lower end face of the oil-gas barrel lid 11 via the flat gaskets. The oil-gas barrel lid 11 has a gas discharging hole 9 located above and in air-communication with a space surroundingly defined by the secondary oil-gas separator 14, and the gas discharging hole 9 is configured to discharge the filtered high-pressure gas. The gas discharging hole 9 is sealingly connected to a pressure maintenance valve 5. The oil-gas barrel lid 11 has an oil discharging hole located above the secondary oil-gas separator 14 and communicated with the space surroundingly defined by the secondary oil-gas separator 14. A secondary oil return steel pipe 12 is inserted into the oil discharging hole communicated with the space surroundingly defined by the secondary oil-gas separator 14, a lower end of the secondary oil return steel pipe 12 is arranged adjacent to a bottom portion of the secondary oil-gas separator 14, and an upper end of the secondary oil return steel pipe 12 is fastened to the oil-gas barrel lid 11 by a steel pipe fitting (the threaded connection portion needs to be sealed) and is sealingly connected to an end of a secondary high pressure oil pipe 8 via a check valve 6. The secondary oil return steel pipe 12 is configured to recycle the lubricating oil of the secondary oil-gas separator 14. The oil-gas barrel lid 11 has another oil discharging hole located above the position between the secondary oil-gas separator 14 and the main oil-gas separator 15 and communicated with the space surroundingly defined by the main oil-gas separator 15. A main oil return steel pipe 13 is inserted into the oil discharging hole communicated with the space surroundingly defined by the main oil-gas separator 15, a lower end of the main oil return steel pipe 13 is arranged adjacent to a bottom portion of the main oil-gas separator 15, and an upper end of the main oil return steel pipe 13 is fastened to the oil-gas barrel lid 11 by another steel pipe fitting and is sealingly connected to an end of a main high pressure oil pipe 7 via another check valve 6. The main oil return steel pipe 13 is configured to recycle the lubricating oil of the main oil-gas separator 15.

Figure 4:
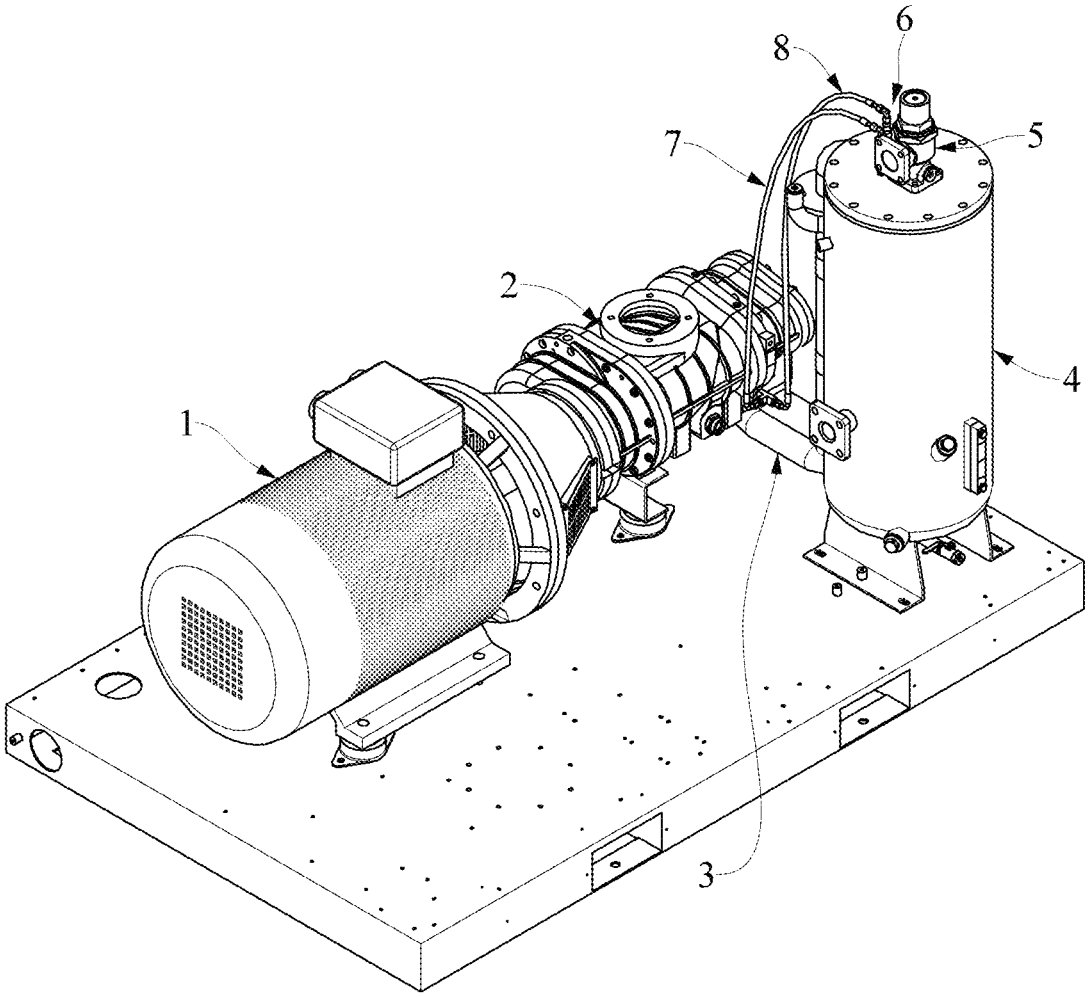
FIG. 4 is a perspective view showing the built-in oil-gas separating device according to the embodiment of the present disclosure.

The specific operation of this embodiment is shown in FIG. 4. A motor 1 drives a machine body 2 to work after obtaining electric power to discharge the high-pressure oil-gas mixture and make the high-pressure oil-gas mixture flow into the oil-gas barrel 4 along a gas discharging pipe 3. After flowing into the oil-gas barrel 4, the high-pressure oil-gas mixture hits the oil-gas barrel liner 10 first, and then fills the entire oil-gas barrel 4. The high-pressure oil-gas mixture filled in the oil-gas barrel 4 is filtered by the main oil-gas separator 15 and the secondary oil-gas separator 14, and is discharged through the pressure maintenance valve 5. Meanwhile, the lubricating oil left over the bottom portions of the main oil-gas separator 15 and the secondary oil-gas separator 14 is guided back into the machine body 2 through the main oil return steel pipe 13, the secondary oil return steel pipe 12, the check valves 6, the main high pressure oil pipe 7, and the secondary high pressure oil pipe 8. The other end of the main high pressure oil pipe 7 and the other end of the secondary high pressure oil pipe 8 are respectively and sealingly connected to two oil return holes located at a side of the machine body 2, and the two oil return holes are communicated with a compressing chamber of the machine body 2. When the machine body 2 is operating, the compressing chamber has a negative pressure. Therefore, the machine body 2 is capable of directly sucking and recycling the lubricating oil left over the bottom portions of the main oil-gas separator 15 and the secondary oil-gas separator 14.

The descriptions illustrated supra set one simply the preferred embodiment of the present disclosure; however, the characteristics of the present disclosure are by no means restricted thereto. All changes, alterations, or modifications conveniently considered by those skilled in the art are deemed to be encompassed within the scope of the present disclosure delineated by the following claims.

What is claimed is:

1. A built-in oil-gas separating device, comprising: a secondary oil-gas separator, a main oil-gas separator, an oil-gas barrel, an oil-gas barrel liner, and an oil-gas barrel lid, wherein the secondary oil-gas separator is disposed inside the main oil-gas separator, the oil-gas barrel liner is disposed around the main oil-gas separator, the oil-gas barrel liner is disposed inside the oil-gas barrel, an upper end face of the secondary oil-gas separator and an upper end face of the main oil-gas separator are sealingly connected to a lower end face of the oil-gas barrel lid, the oil-gas barrel lid has a gas discharging hole located above and in air-communication with a space surroundingly defined by the secondary oil-gas separator, and the gas discharging hole is sealingly connected to a pressure maintenance valve.

2. The built-in oil-gas separating device according to claim 1, wherein the oil-gas barrel lid has two oil discharging holes respectively communicated with the space surroundingly defined by the secondary oil-gas separator and a space surroundingly defined by the main oil-gas separator, a secondary oil return steel pipe is inserted into the oil discharging hole communicated with the space surroundingly defined by the secondary oil-gas separator, a lower end of the secondary oil return steel pipe is arranged adjacent to a bottom portion of the secondary oil-gas separator, an upper end of the secondary oil return steel pipe is sealingly connected to an end of a secondary high pressure oil pipe via a check valve, a main oil return steel pipe is inserted into the oil discharging hole communicated with the space surroundingly defined by the main oil-gas separator, a lower end of the main oil return steel pipe is arranged adjacent to a bottom portion of the main oil-gas separator, an upper end of the main oil return steel pipe is sealingly connected to an end of a main high pressure oil pipe via another check valve, the other end of the main high pressure oil pipe and the other end of the secondary high pressure oil pipe are respectively and sealingly connected to two oil return holes located at a side of a machine body, and the two oil return holes are communicated with a compressing chamber of the machine body.

* * * * *